US005526995A

United States Patent [19]

Westrich et al.

[11] Patent Number: 5,526,995

[45] Date of Patent: Jun. 18, 1996

[54] YARN WINDING METHOD

[75] Inventors: Hermann Westrich, Wuppertal; Albert Stitz, Kürten, both of Germany

[73] Assignee: Barmag AG, Remscheid, Germany

[21] Appl. No.: 140,197

[22] PCT Filed: Mar. 2, 1993

[86] PCT No.: PCT/DE93/00179

§ 371 Date: Dec. 14, 1993

§ 102(e) Date: Dec. 14, 1993

[87] PCT Pub. No.: WO93/17949

PCT Pub. Date: Sep. 16, 1993

[30] Foreign Application Priority Data

Mar. 5, 1992 [DE] Germany ..... 42 06 961.0
May 2, 1992 [DE] Germany ..... 42 14 641.0

[51] Int. Cl.[6] ..... B65H 54/02; B65H 67/044

[52] U.S. Cl. ..... 242/35.5 A; 242/18 A

[58] Field of Search ..... 242/18 A, 35.5 A, 242/35.5 T, 41

[56] References Cited

U.S. PATENT DOCUMENTS 2,385,949 10/1945 Siegenthaler ..... 242/41
3,901,456 8/1975 Pradier ..... 242/18 A
3,964,723 6/1976 Schippers et al. ..... 242/35.5 A
3,974,973 8/1976 Lenk et al. ..... 242/41
3,999,715 12/1976 Schippers et al. ..... 242/18 A
4,014,476 3/1977 Turk et al. ..... 242/41 X
4,305,551 12/1981 Cockshott et al. ..... 242/35.5 A
5,029,762 7/1991 Behrens et al. .
5,228,630 7/1993 Nakai et al. ..... 242/18 A
5,234,173 8/1993 Nishikawa et al. ..... 242/18 A

FOREIGN PATENT DOCUMENTS 0374536 6/1990 European Pat. Off. .

*Primary Examiner*—Daniel P. Stodola
*Assistant Examiner*—Michael R. Mansen
*Attorney, Agent, or Firm*—Bell, Seltzer, Park & Gibson

[57] ABSTRACT

A yarn winding method for an apparatus with a rotatable turret accommodating two winding spindles which are alternately moved to a winding range and to a doffing range for replacing full packages with empty tubes, the doffing range having two stopping positions, and the exchange of fully wound packages and empty tubes occurring in two steps.

6 Claims, 7 Drawing Sheets

YARN WINDING METHOD

BACKGROUND OF THE INVENTION

The present invention relates to a yarn winding apparatus of the type having a rotatable turret or revolver which mounts a pair of winding spindles, and wherein the spindles are serially delivered to a winding position and a doffing position as the revolver is sequentially rotated.

Winding machines of the above-described type commonly employ a contact roll which is positioned to rest upon the package being formed on the spindle at the winding position. Also, designs are known wherein the revolver is rotated to provide relative movement between the contact roll and the winding spindle as the package diameter builds, note for example, EP-A 374536 and corresponding U.S. Pat. No. 5,029,762.

In such a yarn winding apparatus, it is necessary, at the end of a winding cycle, to remove the full packages from the idle spindle and to replace them with new empty tubes, since the yarn advances continuously.

A compact type of construction is attempted for the package revolver. This means that the two winding spindles are to be brought together as closely as possible. As a result, there is the risk that the rapidly increasing package enlarges toward the fully wound, yet to be doffed package and destroys the winding head.

On the other hand, a certain doffing time is required to remove the full packages and to insert empty tubes onto the doffed winding spindles.

It is the object of the present invention to provide a method, in which an adequate doffing time is always available, despite the narrow spacing between the winding spindles, for replacing the full packages with empty tubes.

SUMMARY OF THE PRESENT INVENTION

The above and other objects and advantages of the present invention are achieved in the embodiments illustrated herein by the provision of a method which comprises the steps of providing a revolver which is rotatable about a central axis and which rotatably mounts two spindles which are rotatable about respective axes which are parallel to the central axis and with the two spindles being equally spaced about the periphery of the revolver, and rotating the revolver so as to alternately move the spindles between the winding position and a doffing position. The method includes the further steps of (a) winding the advancing yarn onto a rotating empty bobbin tube which is positioned coaxially upon one of the spindles which is positioned at the winding position, while rotating the revolver about the central axis so that the one spindle moves from the winding position and defines an angular winding range during which a full yarn package is formed on the bobbin tube, (b) donning an empty bobbin tube coaxially upon the other of the two spindles while the one spindle is within the winding range, then (c) rotating the revolver so that the one spindle and the full package move to the doffing position and the other spindle and the donned empty bobbin tube move to the winding position, and then stopping the revolver, (d) transferring the advancing yarn from the full package to the donned empty bobbin tube which is positioned at the winding position, and (e) doffing the full package from the one spindle while the revolver is stopped with the full package at the doffing position, and (f) cyclically repeating steps (a) through (e).

In a preferred embodiment, step (b) includes stopping the revolver at a second stopping position which is angularly spaced from the doffing position by a sector angle which is less than the winding range, and donning an empty bobbin tube coaxially upon the other of the spindles while the revolver is in the second stopping position. Further, the second stopping position is at a location wherein the one spindle is at least about at the mid-point of the winding range.

From the invention, there results the advantage that the time necessary for the exchange of full packages and empty bobbin tubes is divided into two time periods.

The first time period is very short, since during this time period it is necessary to only push the full packages from the idle spindle. The devices necessary therefor are arranged on the winding head itself. Insofar the winding head is self-contained, so that the time needed for pushing off the full packages is exclusively dependent on the characteristic speed of the devices. It is thus accomplished that the actual, critical phase of the doffing procedure, during which there is the risk that the new package increases toward the undoffed package, is shifted to this first time period, which is very short. As a result, a narrow spacing between the two winding spindles is made possible.

During the doffing phase, the turret is unable to rotate further. This results in that the movably supported contact roll must give way to the increasing package. The maximum length of the evading movement which is available, may, in accordance with the invention, be kept likewise short.

After the first phase of the doffing operation, the turret is further rotated slowly or in timed fashion in accordance with the increasing package diameter, so that the contact roll remains substantially at its location. At this time, it is necessary to furnish the empty tubes, be it by hand or by an automat. Then, the turret is again stopped, and the doffing operation proceeds with its second phase.

The second phase of the doffing operation comprises the slipping of empty tubes onto the waiting idle spindle. The duration of this second phase is likewise short, since it is only necessary to transfer, but not to furnish the empty tubes. Thus, the sum of the two time periods as required by the present invention is smaller than the doffing time needed in accordance with the prior art. Further, the second phase of the doffing operation is separated in time from the first phase. Therefore, the new package has increased already to a larger diameter and increases now less rapidly. Consequently, there is no risk that during a stop of the turret the contact roll moves right to the end of its evading path.

The invention proceeds from the fact that always a plurality of such yarn winding apparatuses are simultaneously operated in a spinning plant, whereby the problem may arise that it is not possible to service always all yarn winding apparatuses simultaneously when a package doff becomes necessary.

This may give rise to the problem that the empty tubes are not supplied in time. To avoid this breakdown in the operation, an early alarm signal may be emitted at or before the start of the dwelling time of the winding spindle in the second stopping position.

This early alarm signal allows to call the operator or the automat so as to furnish the empty tubes.

A stationary empty tube pushing device may be associated with the second stopping position, and a package receiving device may be associated with the first stopping position for the temporary storage of the full packages removed from the idle spindle. This renders it possible to push off the full packages in the first stopping position, and to rapidly slip on the empty tubes in the second stopping position.

In accordance with the invention, this intermediate storage device will not adversely affect the supply of empty tubes, it being only important to space the second stopping position far enough from the first stopping position.

The use of a stationary empty tube pushing device enables a fully automatic insertion of empty tubes, and a fully automatic winding operation may be achieved with the use of the temporary package receiving device.

BRIEF DESCRIPTION OF THE DRAWINGS

Some of the objects and advantages of the present invention having been stated, others will appear as the description proceeds, when considered together with the accompanying schematic drawings, in which.

In the drawing.

DETAILED DESCRIPTION OF THE PREFERRED EMBODIMENT

Figure 1:
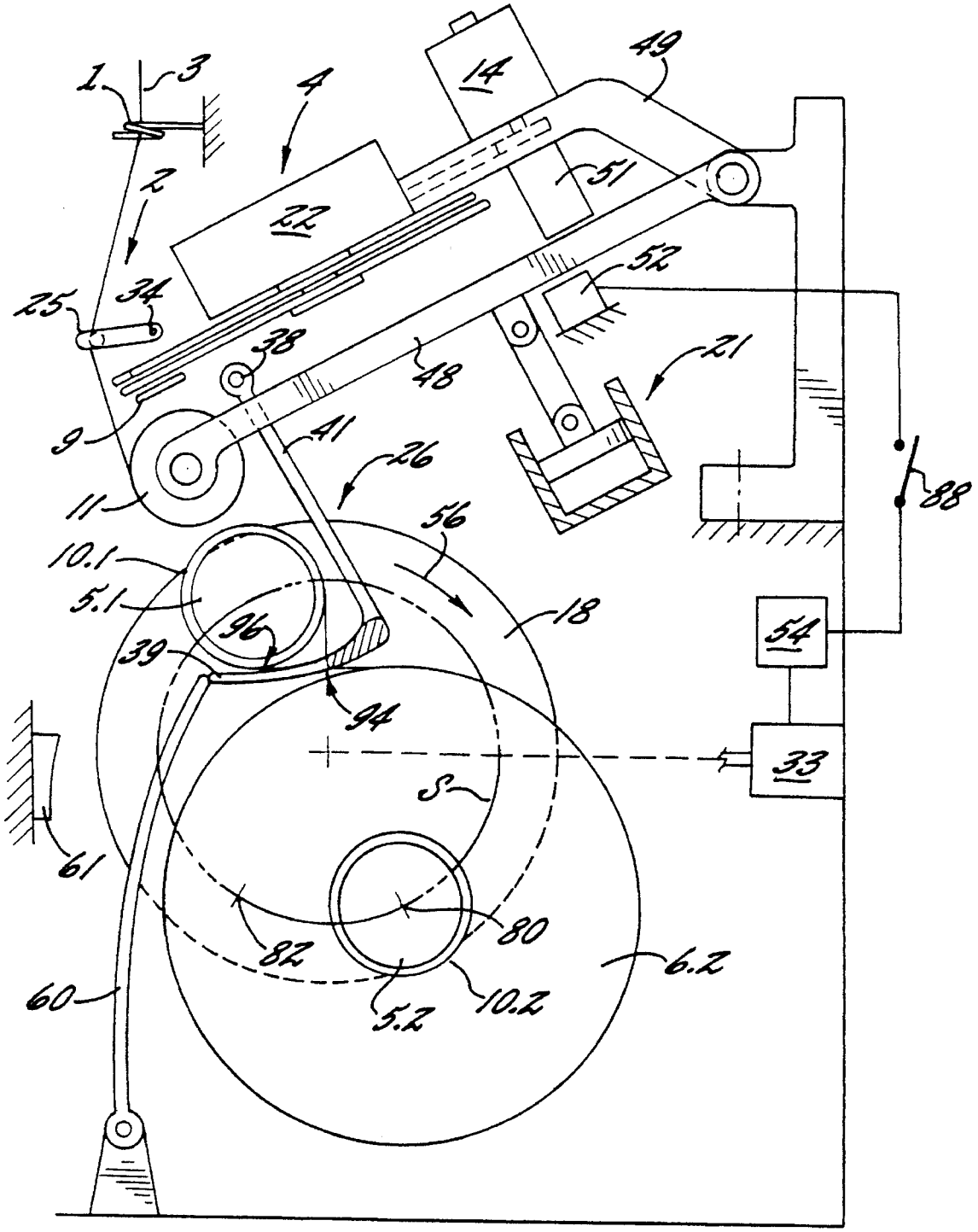
FIG. 1 illustrates a yarn winding apparatus having two stopping positions in accordance with the invention in a side view of the winding spindles.

Unless otherwise specified, the following description will always apply to all FIGS. 1–4D.

For a more detailed description of the illustrated apparatus reference is made to the above-mentioned EP-A 374 536, and corresponding U.S. Pat. No. 5,029,762, the disclosures of which are incorporated herein by reference.

FIGS. 1–4D show each a yarn winding apparatus in accordance with the invention for a continuously advancing synthetic filament yarn 3 with a turret 18. Supported on turret 18 are two winding spindles 5.1, 5.2, which are moved by the rotation of turret 18 to a winding range 57 and a package doffing range 57'. During the winding operation, the turret 18 is rotated by a rotary drive 33 controlled via the deflection of a contact roll 11 as the diameter of packages 6 increases in winding range 57 during the winding cycle.

Figure 2:
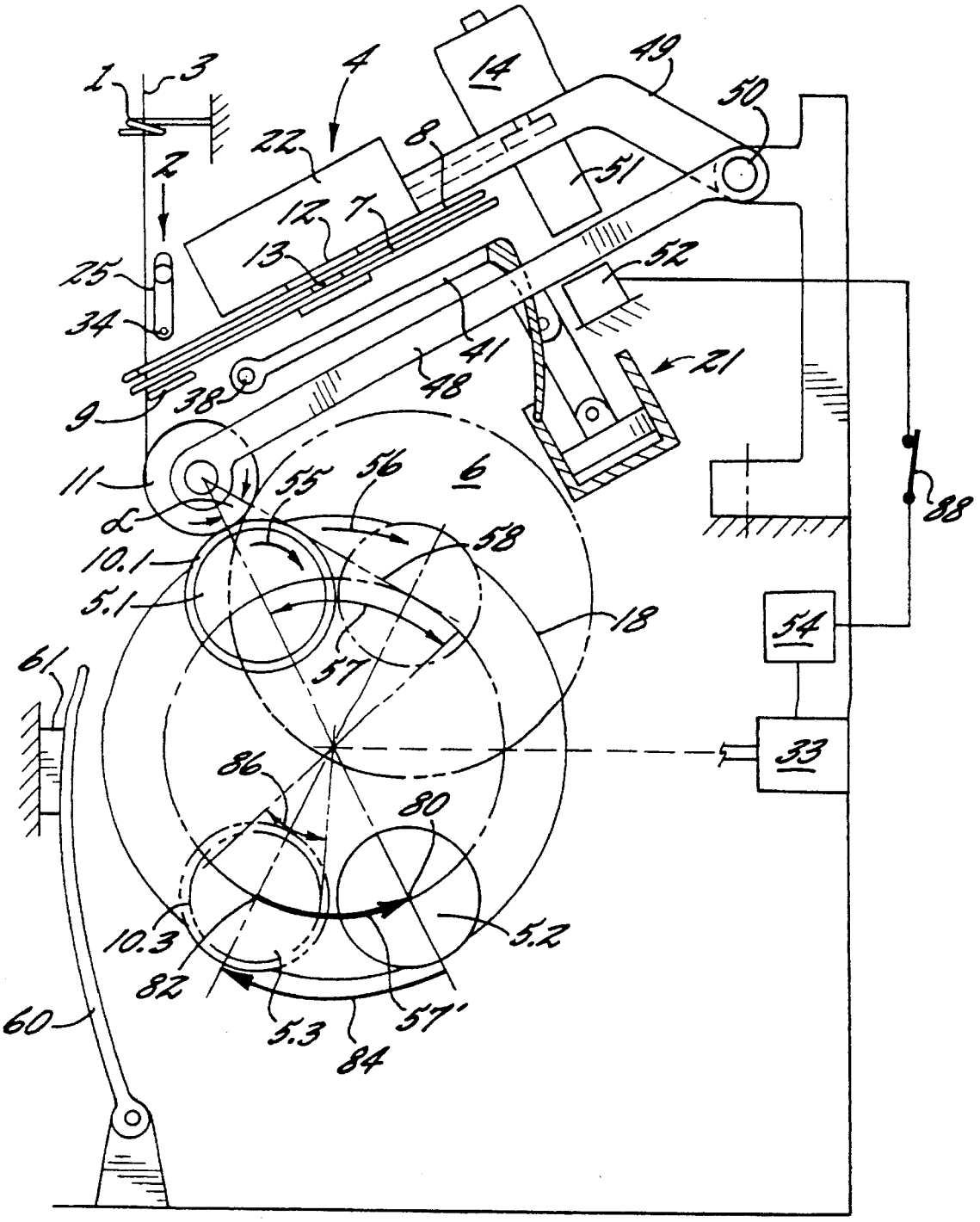
FIG. 2 is a side view in accordance with FIG. 1 in the second stopping position.
Figure 3:
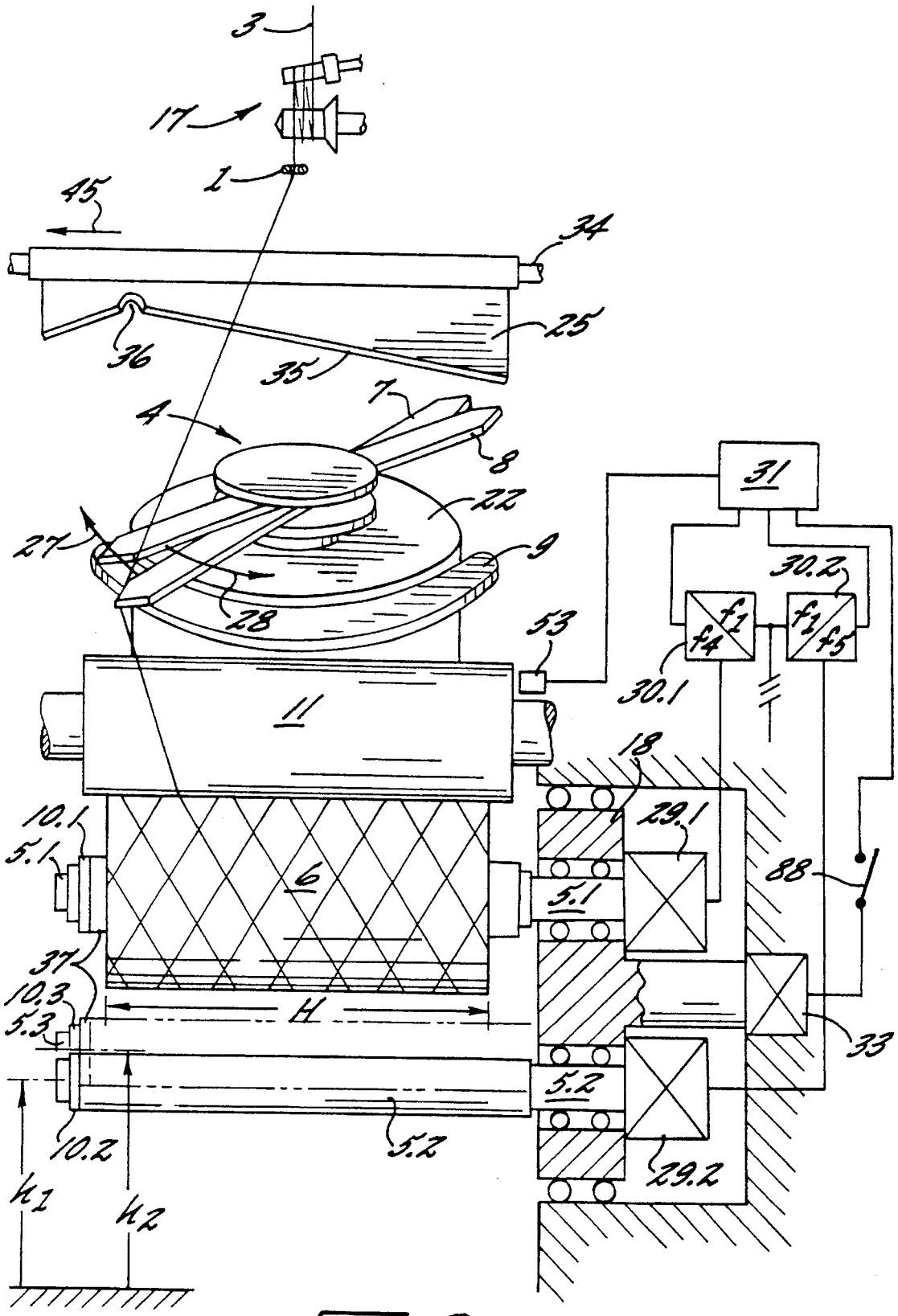
FIG. 3 is a front view of the yarn winding apparatus in operation.

In the present case, the doffing range indicated at 57, in FIG. 2 covers a sector angle 84 with two stopping positions 80, 82. It is characteristic that the sector angle between the second stopping position 82 and the first stopping position 80 is smaller than the sector angle of the winding range 57, in which the package increases up to its desired end diameter. The rotary drive 33 can be interrupted during both stopping times at the stopping positions 80, 82.

The yarn 3 is continually advanced at a constant speed to the yarn winding apparatus of the present invention by a feed system 17. To this end, the yarn 3 passes first through a yarn guide 1 which forms the apex of the traversing triangle. Then, the yarn reaches while advancing in direction 2 a yarn traversing mechanism 4 as is described below. Downstream of yarn traversing mechanism 4, the yarn 3 is deflected about contact roll 11 by more than 90°, and subsequently is wound to a package 6. The latter is formed on a winding tube 10.1. The winding tube 10.1 is clamped on a rotatably driven operating spindle 5.1.

As shown in FIG. 1, the operating spindle 5.1 has just been rotated with winding tube 10.1 clamped thereon by turret 18 to the beginning of the winding range 57, so as to wind there the advancing yarn 3 into a package 6 (note, for example, FIG. 2).

After the operating spindle 5.1 has moved into winding range 57, winding starts to proceed on this operating spindle 5.1. During the winding cycle, the turret 18 is further rotated in the direction of rotation 56 by the motor of rotary drive 33, which is controlled via the evading movement of contact roll 11.

The further rotation occurs as the diameter of package 6 increases during the winding cycle (note FIG. 2). The path covered in this process by operating spindle 5.1 is named winding range 57. At the end of the winding cycle, i.e., when package 6 is completely wound to full package 6.1. The operating spindle 5.1 is moved by a fast rotation of the turret from the end of winding range 57 to doffing range 57'.

This rotation causes the idle spindle having previously been in doffing range 57' (see FIG. 2) to rotate to the beginning of winding range 57, where the winding operation is continued. The turret stops for the time being (first stopping position). Next, the yarn is severed from full package 6.1 along with a synchronously occurring applying of the yarn on empty tube 10.1. To this end a thread transferring device is used which comprises a rocking lever 41 and a sheet metal element 39 attached thereto. Further details of this yarn transferring operation may be noted from the aforesaid EP-A 374 536 publication and U.S. Pat. No. 5,029,762. However, in this first stopping position, it is also necessary to push full package 6.2 from the idle spindle.

To begin with, it is necessary to brake the fully wound package 6.2, which possesses a high kinetic energy. For this purpose, it is possible to short-circuit, for example, drive motor 29.2, so that an electric braking occurs. Likewise, however, it is possible to provide a mechanical brake not shown. Subsequently, it is necessary to push full package 6.2 from winding spindle 5.2. The pushing device is described below. For the braking and removal by pushing, a certain time is needed. The spacing between the two spindles 5.1 and 5.2 on turret 18 must now be selected such that during the braking and removal by pushing, the rapidly increasing package on the now operating spindle 5.1 does not enlarge toward full package 6.1. This would lead to the destruction of the spindles and the entire winding head. Therefore, a certain minimum spacing between the winding spindles is necessary, which corresponds on the one hand to the desired package thickness (diameter) of full package 6.2, and on the other hand to the possible yarn speed as well as yarn fineness (denier). Thus, for a clarification, it should be emphasized that while the full package 6.2 is braked and pushed from spindle 6.2, the winding operation continues now on winding spindle 5.1, so that no waste yarn is produced practically.

The transfer of the yarn from full package 6.2 to empty tube 10.1 thus occurs in the first stopping phase.

To stop the turret in the first stopping position, the control circuit of rotary drive 33 is opened by means of a switch 88 (FIG. 1), and remains opened during the first stopping period necessary for transferring the yarn, and for braking and removing full package 6.1 by pushing, so that rotary drive 33 is interrupted.

Thereafter, the switch is automatically closed, for example, by the actuation of a time relay, so that the rotary drive 33 is again in operation.

The idle spindle 5.2 is now empty. Package 6 continues to increase, and in so doing moves by the rotation of turret 18 in direction 56 toward the clockwise extending end of winding range 57.

Shown in FIG. 2 is the second stopping position of the turret, which extends between the beginning and end of winding range 57. In this position, the turret 18 is stopped once more, and winding spindle 5.2 receives empty tubes. The second stopping position is reached, when the package on winding spindle 5.1 has already increased to a larger diameter. In this position, the diameter increase of the package being wound in operation is relatively small. Therefore, an adequate stopping time is available for the movement of contact roll 11, which as a result of the pivoting of arm 48, must give way to the further increasing diameter, before the arm 48 contacts a stop and the end of the control range of a displacement measuring device 52 and controller 54 is reached.

Thus, the second stopping position 82 is removed as far as possible from the first stopping position in a range, in which the diameter increase of package 6 in winding range 57 is so small as to allow to insert the empty tubes while the turret 18 is stopped, without the speed control of the winding spindle leaving its predetermined range, and without the evading movement of contact roll 11 being limited by a stop. The preferred range of the second stopping position is illustrated at 86 in FIG. 2.

The empty tubes are slipped on by a pushing device 65 which is described below with reference to FIG. 4D.

When the winding spindle has received new empty tubes in the second stopping position, the rotary drive 33 of the turret is restarted by the closing of switch 88. The latter may, for example, be controlled by a corresponding time relay. The winding operation now continues, until the winding spindle 5.1 with the package forming thereon reaches the end of the winding range and is fully wound. Since now the other winding spindle has received the empty tubes, same may very rapidly be brought by the rotation of the turret to the operating range, i.e., to the start of the winding zone. In so doing, as shown in FIG. 1, the contact roll is again raised by a cylinder-piston assembly 21, so that the operating condition illustrated in FIG. 1 is established, and the yarn from the now completed package can be applied to the new empty tube.

Figure 4A:
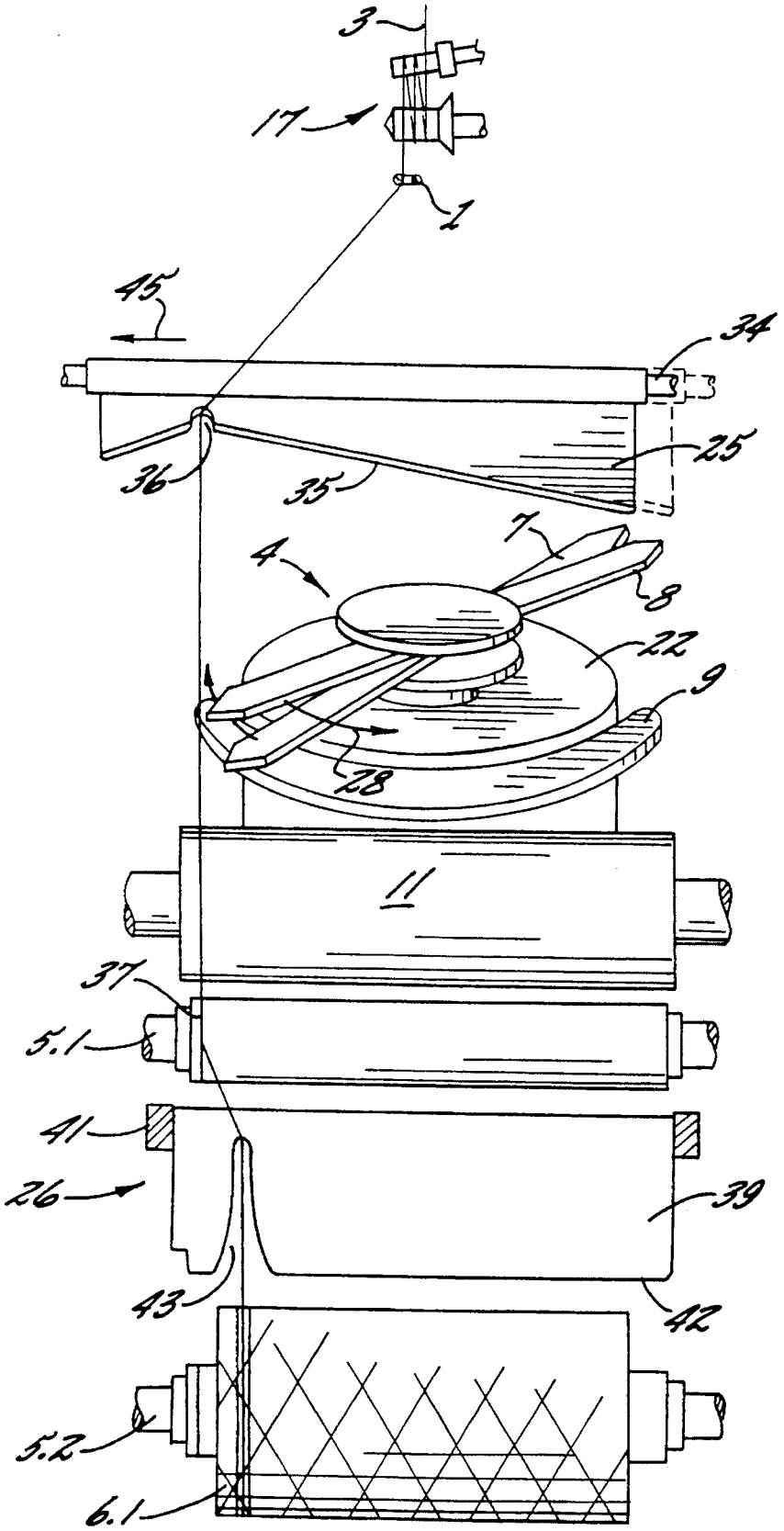
FIGS. 4A–D are each a front view of the yarn winding apparatus during the package doff and the insertion of empty tubes.
Figure 4B:
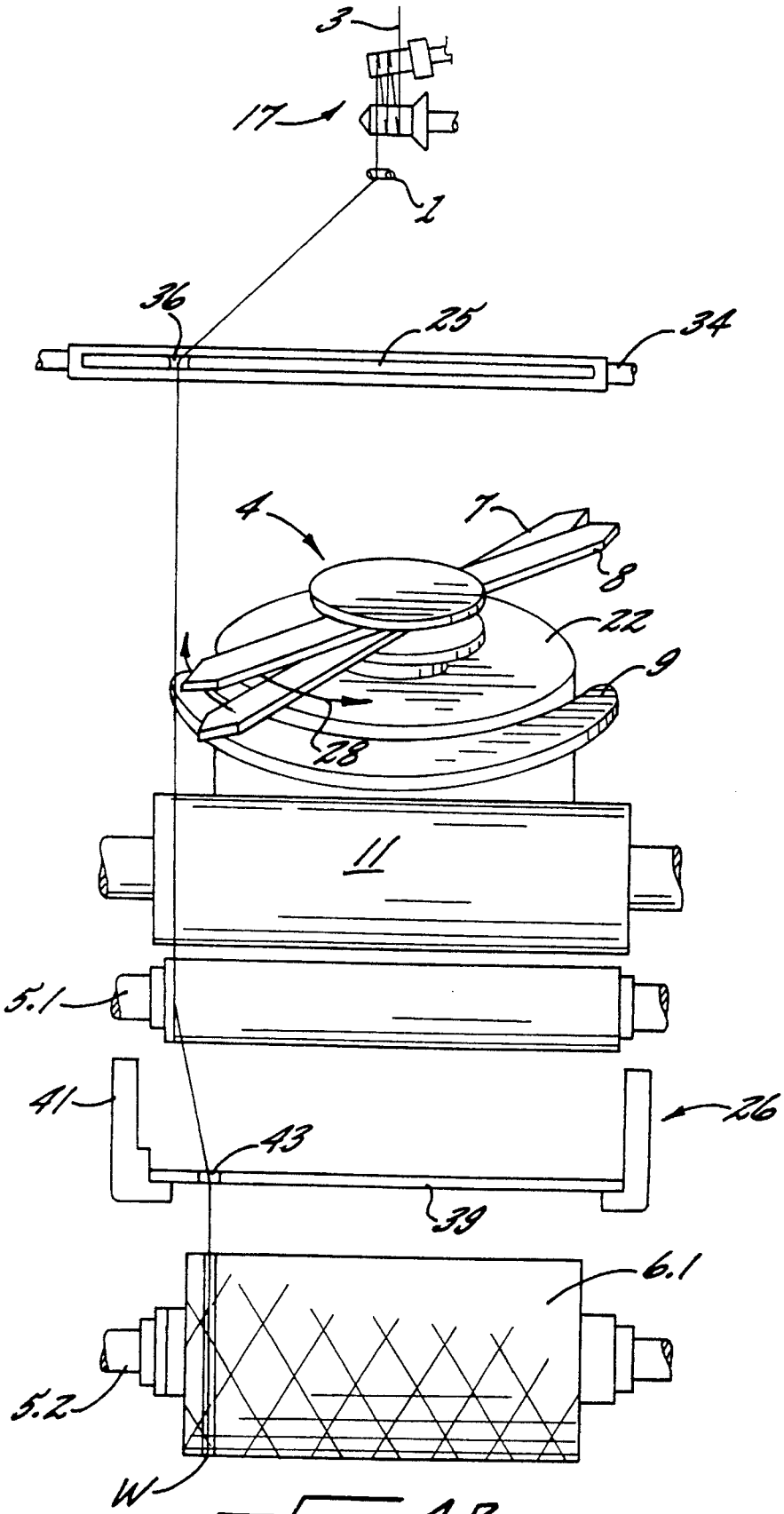
Figure 4C:
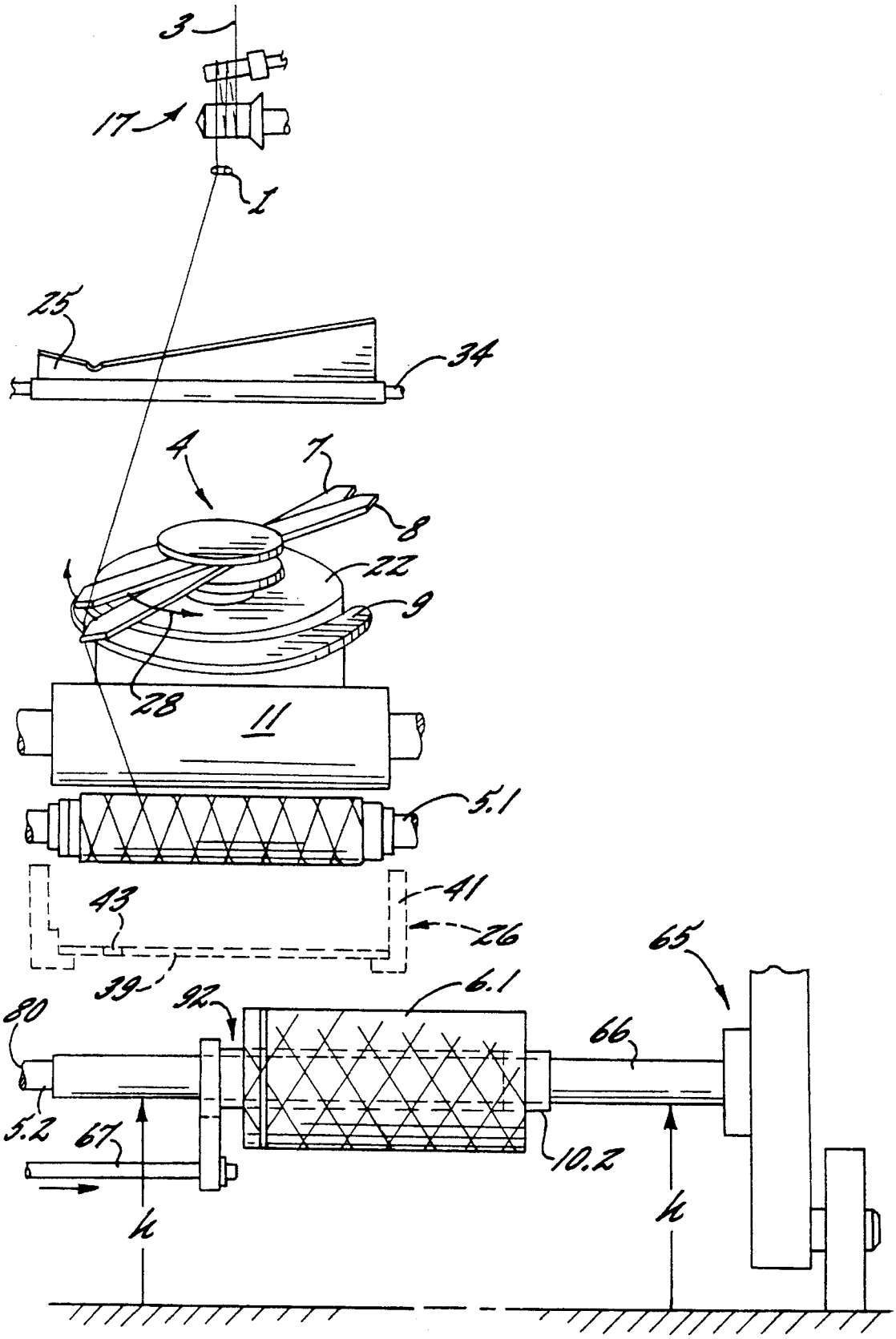

The full package 6.2 is removed from idle spindle 5.2 by means of a doffer which is shown by way of example in FIG. 4C and pertains to a package transport device 65 traveling along the machine front and having in this instance the function of a temporary storage of the packages.

The package transport device 65 is provided at a height h, in which winding spindle 5.2 with full package 6.1 just formed thereon is located during the stopping period in the first stopping position, with a package mandrel 66 which is aligned in this position with idle spindle 5.2. Now, the pushing device 67 is started, which is described, for example, in DE-PS 24 38 363 or corresponding U.S. Pat. No. 3,974,973, which is herewith referred to in its entirety. In the present embodiment, pushing device 67 engages with a fork behind the front end 92 of the winding tube of full package 6.2 facing the machine, and pushes same from idle spindle 5.2 onto package mandrel 66 of doffer 65. Preferably, however, the temporary storage is a receiving device arranged on the yarn winding apparatus, such as is shown, for example, in DE-OS 24 31 567, and corresponding to U.S. Pat. No. 4,007,884. In this instance, the device is a shell adapted to the package diameter, which is arranged below the first stopping position and adapted to move out synchronously with the pushing device 67. This kind of temporary storage has the advantage that it is not necessary in the first stopping position to wait until a doffer is called from other areas of the machine and moved to the winding spindle in the first stopping position.

After the full packages are deposited on the receiving device, switch 88 is closed, and the rotary drive 33 for turret 18 starts up.

Once the winding operation has led to an increase of package 6 to such an extent that meanwhile the second stopping position 82 is reached, switch 88 is again opened.

Figure 4D:
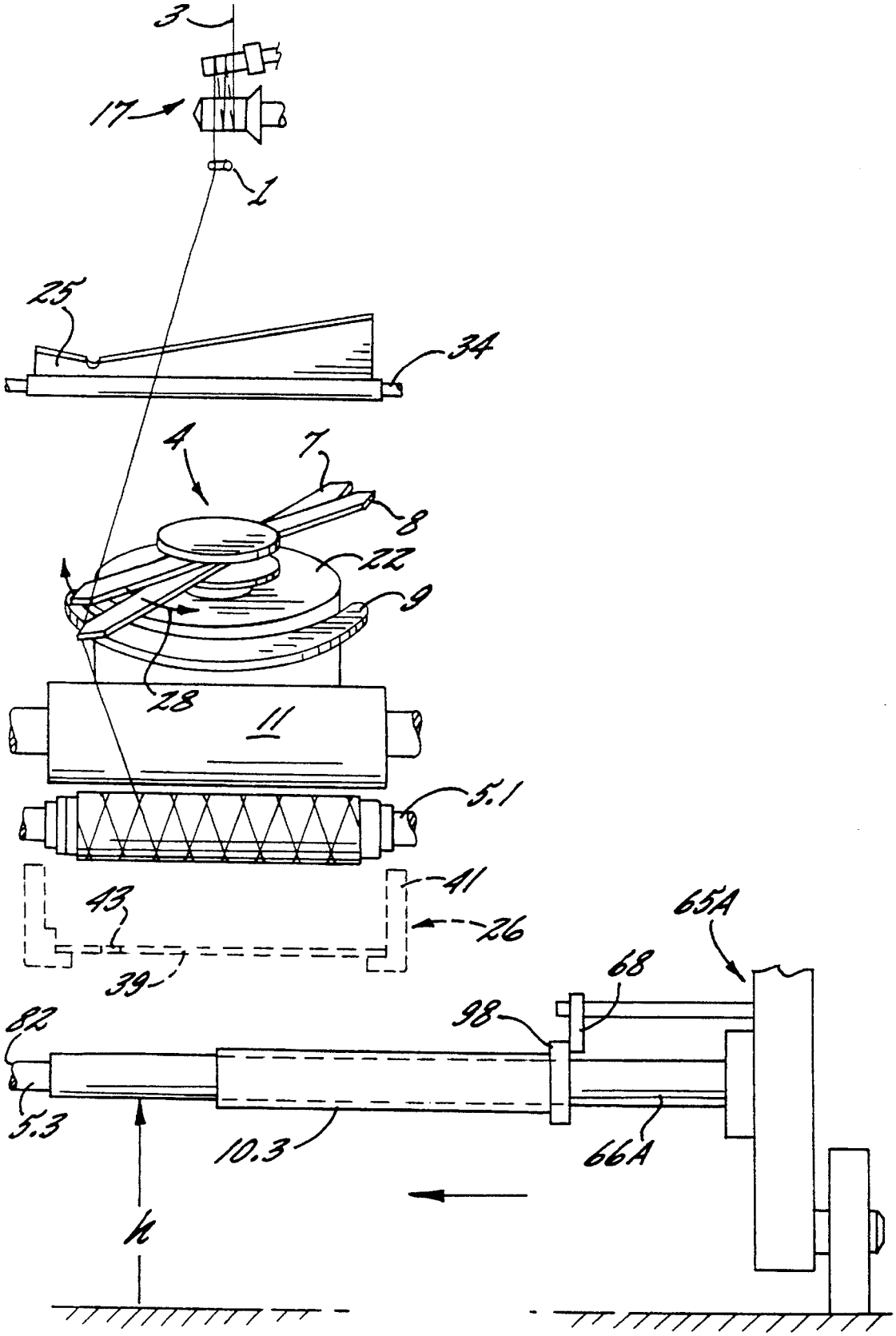

At this moment, as is shown in FIG. 4D, a second doffer 65A is brought with its mandrel 66A in alignment with winding spindle 5.3. Located on mandrel 66A is the necessary number of empty tubes 10.3, which are engaged from behind on their front end 98 facing away from the machine by the fork of a pushing device 68 arranged on the doffer, and pushed onto empty winding spindle 5.3, where they are clamped in place.

We claim:

1. A method for continuously winding an advancing yarn onto bobbin tubes which are serially delivered to a winding position, and comprising the steps of providing a revolver which is rotatable about a central axis and which rotatably mounts two spindles which are rotatable about respective axes which are parallel to said central axis and with the two spindles being equally spaced about the periphery of the revolver, rotating the revolver so as to alternately move the spindles between the winding position and a doffing position, and including (a) winding the advancing yarn onto a rotating empty bobbin tube which is positioned coaxially upon one of the spindles which is positioned at the winding position, while rotating the revolver about said central axis so that the one spindle moves from the winding position and defines an angular winding range during which a full yarn package is formed on the bobbin tube, (b) donning an empty bobbin tube coaxially upon the other of said two spindles at a donning position while the one spindle is within the winding range, then (c) rotating the revolver so that the one spindle and the full package move to said doffing position and the other spindle and the donned empty bobbin tube move to said winding position, and then stopping the revolver, (d) transferring the advancing yarn from the full package to the donned empty bobbin tube which is positioned at the winding position, and (e) doffing the full package from said one spindle while the revolver is stopped with the full package at the doffing position angularly spaced from the donning position, and (f) cyclically repeating steps (a) through (e).

2. The method as defined in claim 1 wherein step (b) includes stopping the revolver at a second stopping position which is angularly spaced from the doffing position by a sector angle which is less than said winding range, and donning an empty bobbin tube coaxially upon the other of said spindles while the revolver is in the second stopped position.

3. The method as defined in claim 2 wherein the second stopping position is at a location wherein the one spindle is at least about at the mid-point of the winding range.

4. The method as defined in claim 3 comprising the further step of emitting an alarm signal upon the revolver at least substantially reaching the second stopping position so as to call for the furnishing of the empty bobbin tubes.

5. The method as defined in claim 1 wherein step (a) includes traversing the yarn at a location upstream of the winding position to form a cross wound package on the bobbin tube, engaging the surface of the package being formed with a contact roll, with the contact roll being mounted for limited movement in a radial direction away from the package as the package builds, and sensing the movement of the contact roll and rotating the revolver so as to laterally move the package being formed and thereby increase the radial distance between the package and the contact roll, and so as to maintain the positioning of the contact roll within a predetermined narrow range of movement during the course of the winding operation.

6. The method as defined in claim 5 where step (b) is performed while said one spindle is at least about at the mid-point of the winding range.

* * * * *